US008197106B2

(12) United States Patent
Chen et al.

(10) Patent No.: US 8,197,106 B2
(45) Date of Patent: Jun. 12, 2012

(54) HOT-MELT GLASS PILLAR LAMP AND MULTI-CHANNEL HEAT DISSIPATION METHOD THEREOF

(75) Inventors: Haisheng Chen, Guangdong (CN); Naiqun Jiang, Guangdong (CN); Chunping Zhang, Guangdong (CN)

(73) Assignee: Shenzhen Tronsin Illuminating Technique Limited, Shenzhen, Guangdong (CN)

( * ) Notice: Subject to any disclaimer, the term of this patent is extended or adjusted under 35 U.S.C. 154(b) by 400 days.

(21) Appl. No.: 12/545,641

(22) Filed: Aug. 21, 2009

(65) Prior Publication Data

US 2010/0046216 A1 Feb. 25, 2010

(30) Foreign Application Priority Data

Aug. 22, 2008 (CN) ..... 2008 1 0141966

(51) Int. Cl.
*F21V 29/00* (2006.01)

(52) U.S. Cl. ..... 362/373; 362/249.02; 362/294; 362/264

(58) Field of Classification Search ..... 362/234
See application file for complete search history.

(56) References Cited

U.S. PATENT DOCUMENTS 7,766,512 B2 * 8/2010 Chou et al. ..... 362/294
7,828,462 B2 * 11/2010 Jensen et al. ..... 362/249.02

* cited by examiner

*Primary Examiner* — Sharon Payne
(74) *Attorney, Agent, or Firm* — Jackson IPG PLLC; Demian K. Jackson

(57) ABSTRACT

A hot-melt glass pillar lamp and a multi-channel heat dissipation method thereof; the pillar lamp comprises a base, a hollow steel frame which is mounted on the middle of the base, several sections of pillar-shaped hot-melt glass lamp which surround the steel frame and are sequentially arranged on the base from down to up in an overlapping manner, and a lamp cover with air outlets, wherein, each section of the pillar-shaped hot-melt glass lamp comprises a fixing framework which is composed of a plurality of supporting bars and a supporting board; each surface of the fixing framework is separately provided with a hot-melt glass lamp plate; an LED lamp plate is arranged at a certain distance from the inner side of each hot-melt glass lamp plate, and on the corresponding surface of the steel frame. The present invention integrates the semiconductor lighting and the crystal optical refraction technologies, has ideal lighting effect and landscape ornament effect; and the pillar lamp is internally provided with at least one air convection channel from down to up, thereby being greatly convenient for the air convection heat dissipation of the power part and the luminous body in the pillar lamp, ensuring a long-term safe use, and meeting the decorative lighting demands of modern high grade buildings.

16 Claims, 3 Drawing Sheets

HOT-MELT GLASS PILLAR LAMP AND MULTI-CHANNEL HEAT DISSIPATION METHOD THEREOF

BACKGROUND OF THE INVENTION

1. Field of the Invention

The present invention involves the technology of glass lamps, particularly involves a hot-melt glass pillar lamp that are adapted for the decorative lighting demands of modern buildings, and a multi-channel heat dissipation method of the hot-melt glass pillar lamp.

2. Description of the Related Art

Glass lamps are products that are widely used in lighting equipments, but the lighting equipments currently in the market mostly have a monotonous appearance, and the decorative function of the lighting equipments are not ideal, which can not meet the decorative lighting demands of modern high grade buildings.

The lighting equipments in modern buildings, particularly in high grade places of literature and art such as a large theater, not only need to have lighting effect and landscape ornament effect, but also need to have artistic connotation matching an art place. No relevant documents currently disclose the design scheme of a large light pillar, which can meet the above mentioned demands, and integrates the semiconductor lighting and the crystal optical refraction technologies.

SUMMARY OF THE INVENTION

To avoid the above mentioned disadvantages of the conventional lighting equipments, the present invention provides a hot-melt glass pillar lamp, and a multi-channel heat dissipation method for a hot-melt glass pillar lamp. A large pillar lamp is formed by multiple sections of pillar-shaped hot-melt glass lamp surrounding a hollow steel frame and being sequentially arranged on a base from down to up in an overlapping manner, and the pillar lamp is internally provided with at least one air convection channel from down to up, thereby being convenient for the air convection heat dissipation of the power part and the luminous body in the pillar lamp, ensuring a long-term safe use, and meeting the decorative lighting demands of modern buildings.

The hot-melt glass pillar lamp of the present invention comprises:

a base, the bottom surface of the base being provided with a chassis, the base being internally provided with a power part;

a steel frame, the steel frame being hollow and mounted on the middle of the base;

several sections of pillar-shaped hot-melt glass lamp surrounding the steel frame and being sequentially arranged on the base from down to up in an overlapping manner; wherein, each section of the pillar-shaped hot-melt glass lamp including a fixing framework which is composed of a plurality of supporting bars and a supporting board, each surface of the fixing framework being separately provided with a hot-melt glass lamp plate; an LED lamp plate being arranged at a certain distance from the inner side of each hot-melt glass lamp plate, and on the corresponding surface of the steel frame; and a lamp cover, the lamp cover being provided with air outlets and mounted to the upper end of the hollow steel frame.

Wherein, the LED lamp plate of the pillar-shaped hot-melt glass lamp is provided with several LEDs emitting white light, which are mounted at intervals.

The lamp cover comprises a cover plate; a ring-shaped connecting part matching the upper opening part of the steel frame extends from the lower surface of the cover plate; each surface of the ring-shaped connecting part is provided with air outlets.

The inner cavity of the base is connected to the hollow space in the steel frame via main vents on the base; the electric door of the base or the base is provided with several air inlets; these air inlets, the inner cavity of the base, the main vents, the hollow space in the steel frame, and the air outlets of the lamp cover at the upper opening part of the steel frame form a first air convection channel, so, the air in the inner cavity of the base, which absorbs the heat emitted by the power part and is hotter than room temperature, flows upward naturally via the first air convection channel to do heat dissipation.

A ring-shaped cavity is formed between the inner walls of the hot-melt glass lamp plates of the pillar-shaped hot-melt glass lamps and the outer walls of the steel frame, and the lower end of the ring-shaped cavity is provided with several through holes being connected to the inner cavity of the base; the air inlets of the electric door or the base, the inner cavity of the base, the through holes being connected to the inner cavity of the base, and the ring-shaped cavity form a second air convection channel, so, the air absorbing the heat emitted by the LED lamps, which is hotter than room temperature, flows upward naturally via the second air convection channel to do heat dissipation.

A multi-channel heat dissipation method for a large hot-melt glass pillar lamp of the present invention comprises:

Step 1. mounting a hollow steel frame on a base, several sections of pillar-shaped hot-melt glass lamp surrounding the steel frame and being sequentially arranged on the base from down to up in an overlapping manner, a ring-shaped cavity being formed between the inner walls of the lamp plates of all the pillar-shaped hot-melt glass lamps and the outer walls of the steel frame, all the luminous bodies being located in the ring-shaped cavity; the lower end of the ring-shaped cavity being connected to the inner cavity of the base via several through holes on the base; the air inlets of the base or the electric door, the inner cavity of the base, the through holes being connected to the inner cavity of the base, and the ring-shaped cavity forming a second air convection channel, so, the air absorbing the heat emitted by the luminous bodies, which is hotter than room temperature, flowing upward naturally via the second air convection channel to do heat dissipation; and Step 2. the inner cavity of the base being connected to the hollow space in the steel frame via the main vents on the base; the air inlets of the base or the electric door, the inner cavity of the base, the main vents, the hollow space in the steel frame, and the air outlets of the lamp cover at the upper opening part of the steel frame forming a first air convection channel, so, the air in the inner cavity of the base, which absorbs the heat emitted by the power part and is hotter than room temperature, flowing upward naturally via the first air convection channel to do heat dissipation. The first air convection channel can be internally provided with a pillar flow fan, so as to increase the air velocity to improve heat dissipation.

The hot-melt glass pillar lamp of the present invention can form a large pillar lamp by multiple sections of pillar-shaped hot-melt glass lamp surrounding a hollow steel frame and being sequentially arranged on a base from down to up in an overlapping manner. The present invention integrates the semiconductor lighting and the crystal optical refraction technologies, has an elegant appearance, is convenient for being used in the interior of modern buildings, is capable of being an integral whole with the corridors inside modern buildings, and has ideal lighting effect and landscape ornament effect.

The present invention adopts LED lamps, and the pillar lamp is internally provided with at least one air convection channel from down to up, thereby being convenient for the natural air convection heat dissipation of the power part and the luminous body in the pillar lamp, ensuring a long-term safe use, belonging to an energy saving green light source.

The hot-melt glass lampshade of the present invention is composed of crystal glass plates with an interlayer of transparent glue-layer, and a layer of crystal pellet glass-head body; while being prepared, by hot-melt method, the crystal glass plates and the layer of crystal pellet glass-head body are moderately combined as one body in a hot melting furnace by slow heating method, then the temperature of the crystal glass plates and the layer of crystal pellet glass-head body in the hot melting furnace is slowly decreased to room temperature, thereby eliminating internal stress, not easily cracking, and being safe and reliable.

DESCRIPTION OF THE PREFERRED EMBODIMENT

Figure 1:
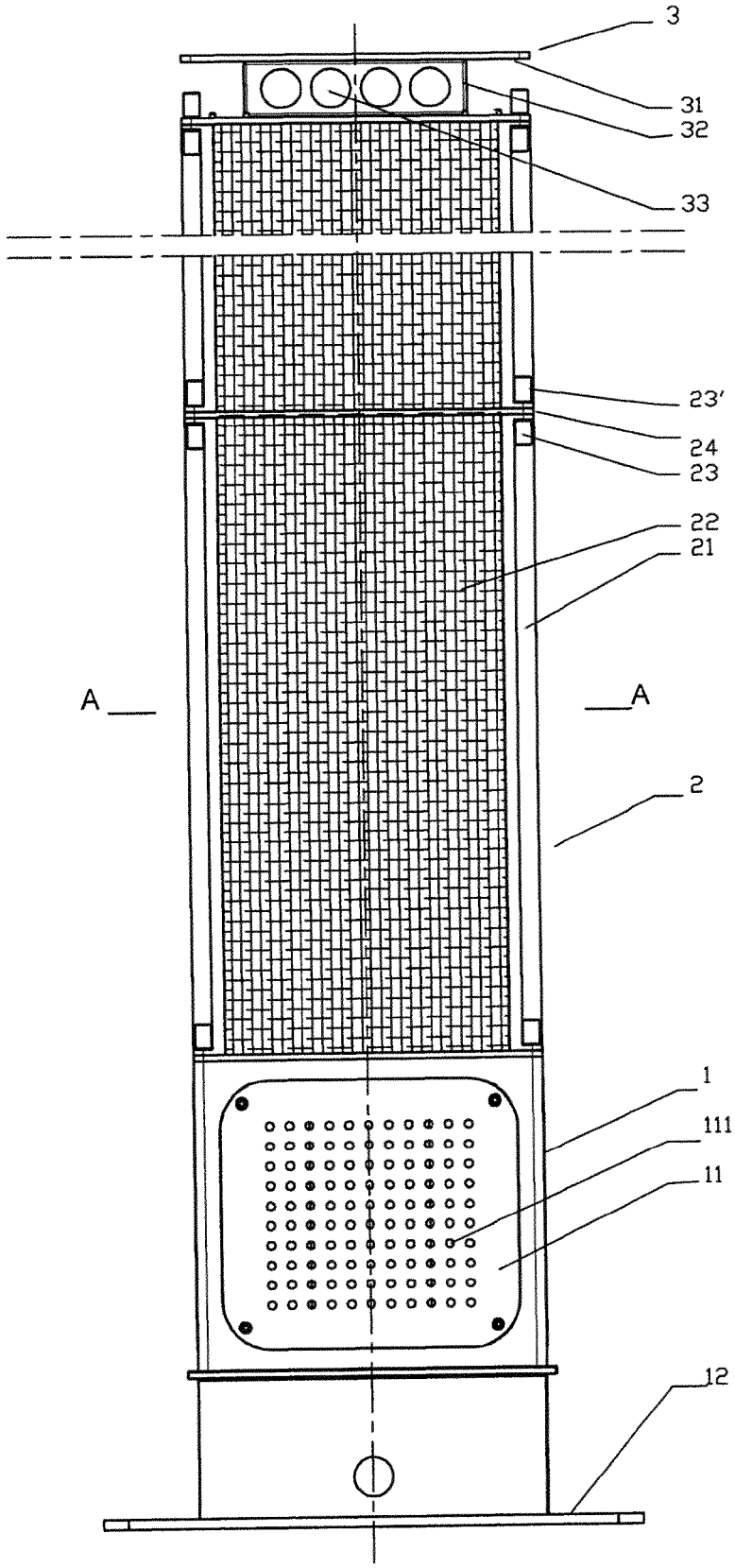
FIG. 1 is a front view of an embodiment of the present invention.
Figure 2:
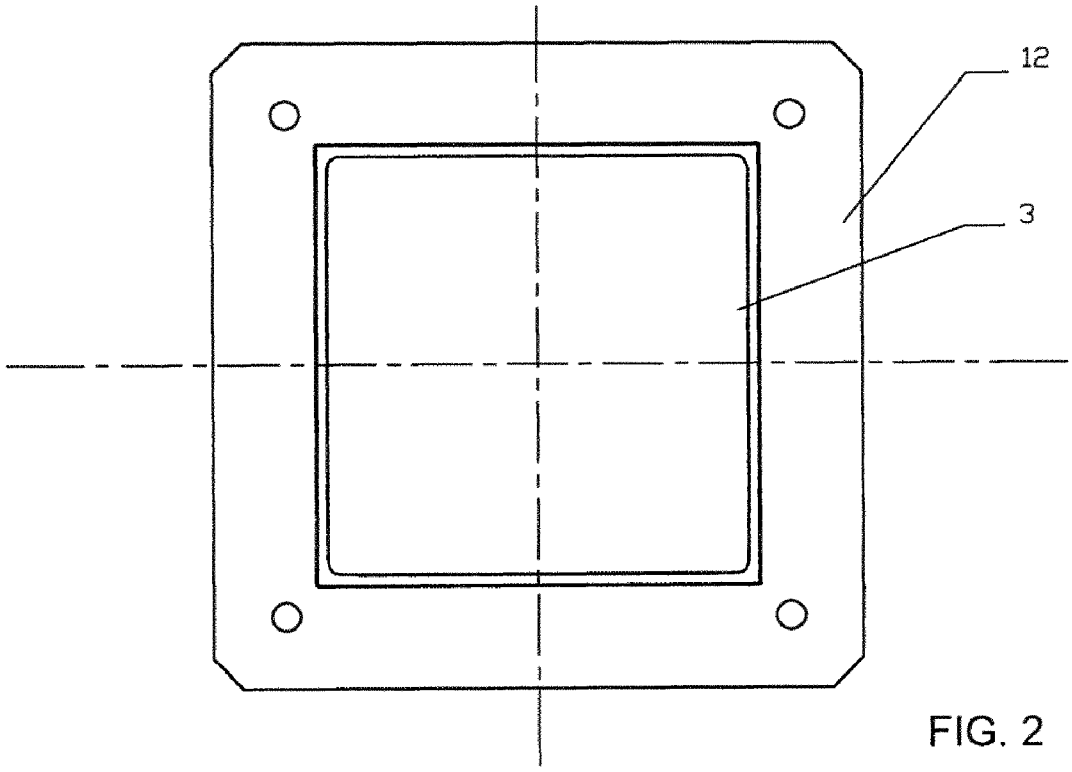
FIG. 2 is a top view of FIG. 1.
Figure 3:
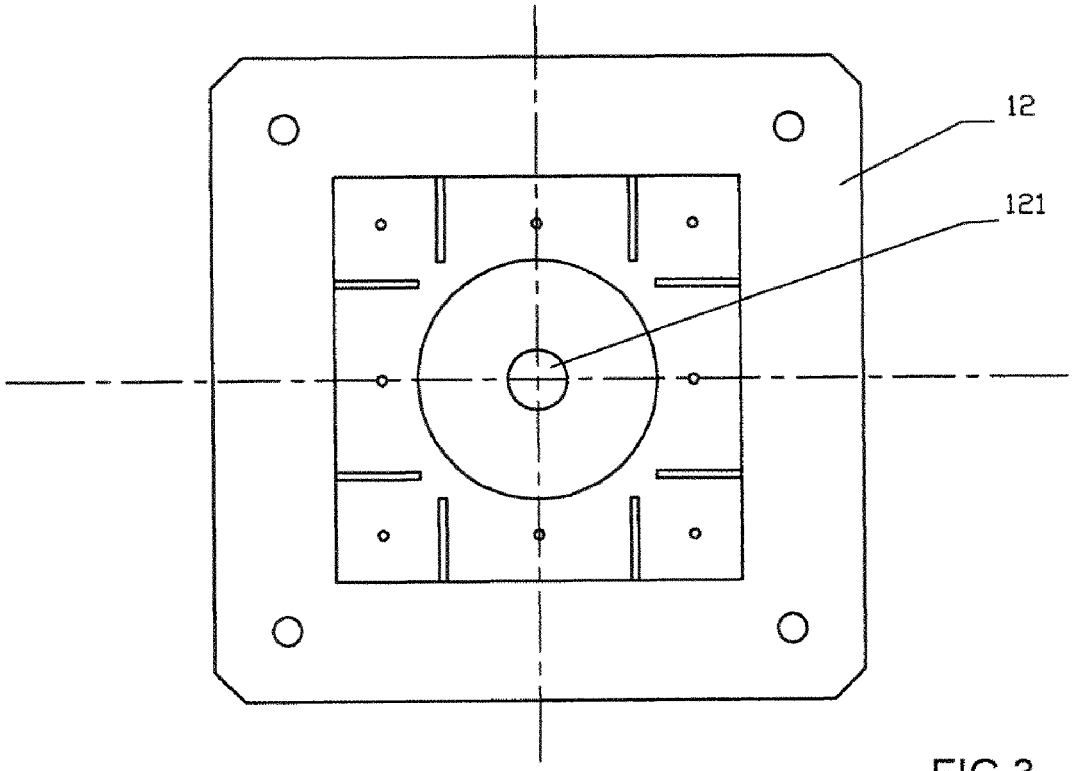
FIG. 3 is a bottom view of FIG. 1.

Aspects of the present invention are best understood from the following detailed description with reference to the embodiments.

Referring to FIGS. 1-4, the hot-melt glass pillar lamp of the embodiment comprises a base 1; the bottom surface of the base 1 is provided with a comparatively big chassis 12, and the inner cavity of the base 1 is provided with the conventional lighting power part, such as a power transformer, a DC power, and a connector being connected to a LED lamp plate. An AC power incoming line passes through a hole 121 under the chassis 12 into the base 1; an electric door 11 is mounted at one surface of the base 1, and the electric door 11 is provided with several air inlets 111. The base 1 and the chassis 12 had better be made of steel.

Figure 4:
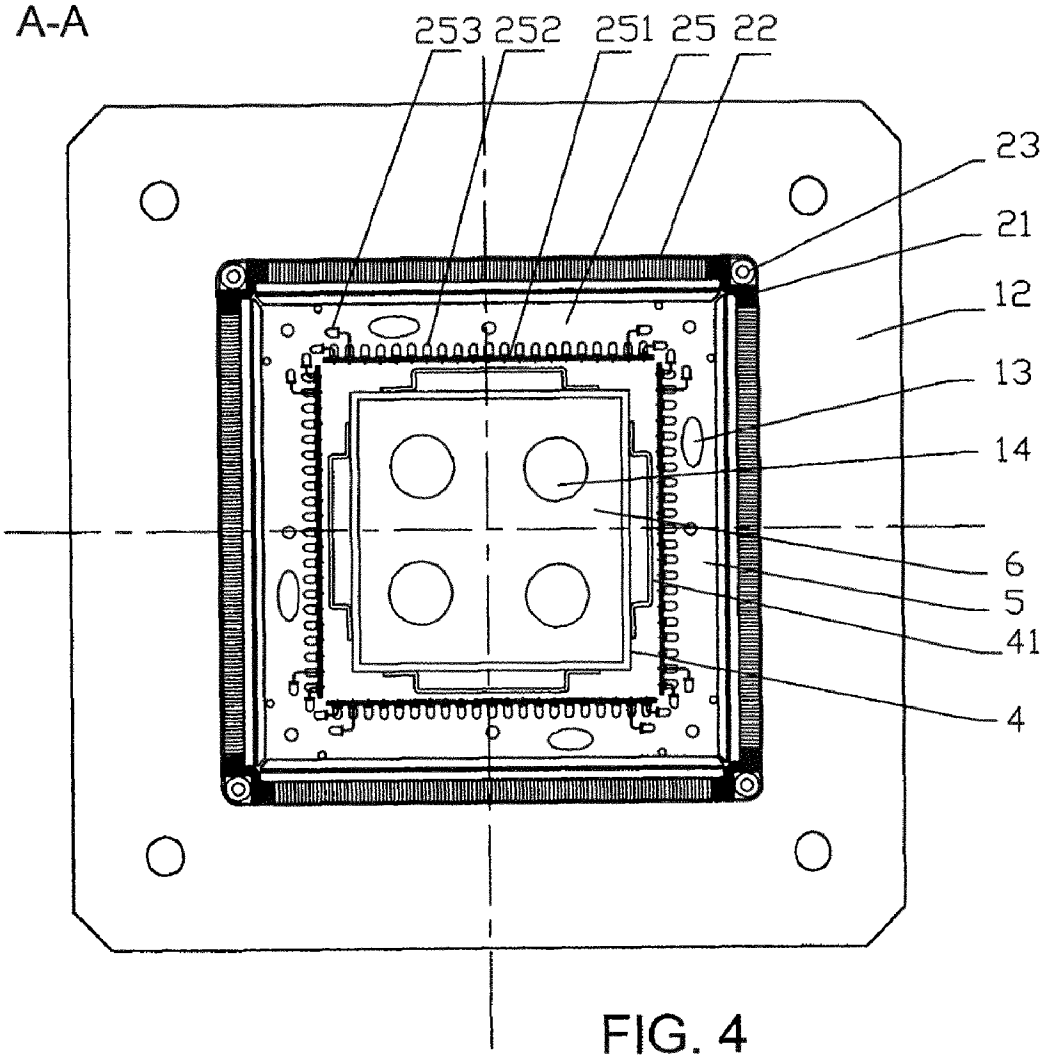
FIG. 4 is an enlarged sectional view of A-A direction in FIG. 1.

The hot-melt glass pillar lamp also comprises a steel frame 4 (as shown in FIG. 4), several sections of pillar-shaped hot-melt glass lamp 2, and a lamp cover 3, etc.

The steel frame 4 is hollow, which is a comparatively long square steel tube in FIG. 4, and the length of the square steel tube can be determined according to the specific demand to the design height of the pillar lamp; the steel frame is mounted on the middle of the base 1, and the hollow space 6 at the middle of the steel frame 4 is a part of an air convection channel in the pillar lamp.

The lamp cover 3 is mounted to the upper end of the hollow steel frame 4, and the lamp cover 3 comprises a cover plate 31; a ring-shaped connecting part 32 matching the upper opening part of the steel frame 4 extends from the lower surface of the cover plate 31; each surface of the ring-shaped connecting part 32 is provided with air outlets 33.

The quantity of the sections of the pillar-shaped hot-melt glass lamp 2 is determined according to the specific demand to the design height of the pillar lamp. They surround the steel frame 4, and are sequentially arranged on the base 1 from down to up in an overlapping manner.

Each section of the pillar-shaped hot-melt glass lamp 2 comprises a fixing framework which is composed of four supporting bars 21 and a supporting board 24; the four surfaces of the fixing framework is separately provided with a hot-melt glass lamp plate 22; an LED lamp plate 25 is arranged at a certain distance from the inner side of each hot-melt glass lamp plate 22, and on the corresponding surface of the steel frame 4. In FIG. 4, the LED lamp plates 25 of each section of the pillar-shaped hot-melt glass lamp 2 are separately fastened via the fixing part 41 mounted at the corresponding surface of the steel frame 4, and are connected to the power part in the inner cavity of the base 1 via cables; the four LED lamp plates 25 surround the outer side of the steel frame 4 as a square, and the four hot-melt glass lamp plates 22 mounted at the four surfaces of the fixing framework also surround as a bigger square, so as to make the four LED lamp plates 25 to be located in the ring-shaped cavity 5 between the inner walls of the four hot-melt glass lamp plates 22 and the outer walls of the square steel frame 4. The supporting board 24 of the connecting part of the upper and lower adjacent pillar-shaped hot-melt glass lamps 2 is a metal part; the supporting board 24 is internally provided with a cavity, and the four corners of the supporting board 24 is provided with via holes of bolts. The supporting bars 21 adopt steel sections; the outer side of the supporting bars 21 is provided with inner grooves capable of containing fastening pieces, and the connecting parts at the two ends of the supporting bars 21 are vertically provided with connecting holes; the supporting bars 21' and the supporting board 24 of the upper section of pillar-shaped hot-melt glass lamp, and the supporting bars 21 of the lower section of pillar-shaped hot-melt glass lamp are connected as one body via the fastening pieces, such as the stud bolts 23 and the nuts 23'.

The LED lamp plates 25 of the pillar-shaped hot-melt glass lamp 2 had better be provided with several LEDs 252 emitting white light, which are mounted at intervals. The mounting interval can be determined according to the design requirements; the row spacing or the column spacing of the LEDs on the LED lamp plates 25 can be between 8 mm and 20 mm. For example, if LEDs (¢5 mm, voltage 3V) emitting white light are adopted, the corresponding row spacing or column spacing can be between 10 mm and 12 mm.

While being used, after the power is on, the LEDs of each section of pillar-shaped hot-melt glass lamp all emit whit light, and the light passes through the hot-melt glass lamp plate to form a light pillar emitting white light.

In the present invention, the LEDs on the LED lamp plates 25 are not limited to LEDs emitting white light, and, LEDs emitting light of other colors are also applicable; the light color of the LEDs can be determined according to the customer requirement.

To increase the luminance of the four corners of the pillar-shaped hot-melt glass lamp 2, the longitudinal edges of each LED lamp plate 25 can also be provided with one to three columns of LEDs 253 emitting white light; these LEDs 253 emitting white light are higher than the other LEDs 252, and they incline towards the longitudinal edge of the adjacent hot-melt glass lamp plate; the angle between the axis of these LEDs 253 and the surface of the base plate 251 of the LED lamp plate 25 can be between 0° and 45°; in FIG. 4, the axis of these LEDs 253 is parallel to the base plate 251 of the LED lamp plate 25.

According to the size of the specific building and the requirement of the mounting location, the cross-section shape of the hot-melt glass pillar lamp of the present invention can be rectangular, rhombic, or polygonal, etc.

The pillar lamp of the present invention is mainly designed for the decorative lighting demands of modern buildings, of which the overall dimension is big, and the height is much higher than conventional products. For example, a special large pillar lamp designed for a large building is composed of five sections of pillar-shaped hot-melt glass lamp; each section of pillar-shaped hot-melt glass lamp is 650 mm high, 400 mm long, 400 mm wide; the height of the base is 477 mm, and the overall height of the pillar lamp is 3790.5 mm. For this kind of large pillar lamps, heat dissipation, energy saving, safe operation, etc. are all problems that need to be considered first.

In the pillar lamp of the present invention, the following two air convection channels are designed. The inner cavity of the base 1 is connected to the hollow space 6 in the steel frame 4 via several main vents 14; in FIG. 4, the main vents 14 are located in the hollow steel frame 4, and on the upper surface of the base 1. The electric door 11 of the base 1 is provided with several air inlets 111, and the air inlets can also be provided on the base 1. These air inlets 111, the inner cavity of the base 1, the main vents 14, the hollow space 6 in the steel frame 4, and the air outlets 33 of the lamp cover 3 at the upper opening part of the steel frame 4 form a first air convection channel, so, the air in the inner cavity of the base 1, which absorbs the heat emitted by the power part and is hotter than room temperature, flow upward naturally via the first air convection channel to do heat dissipation.

A ring-shaped cavity 5 is provided between the inner walls of the hot-melt glass lamp plates 22 of all the above mentioned pillar-shaped hot-melt glass lamps 2 and the outer walls of the steel frame 4, and all the LED lamp plates 25 are located in the ring-shaped cavity 5; the upper end of the ring-shaped cavity 5 is open, and the lower end can be provided with several through holes 13 outside the hollow steel frame 4, on the upper surface of the base 1, to be connected to the inner cavity of the base 1; the air inlets 111 of the electric door 11, the inner cavity of the base 1, the through holes 13 being connected to the inner cavity of the base 1, and the ring-shaped cavity 5 form a second air convection channel, so, the air absorbing the heat emitted by the LEDs, which is hotter than room temperature, flow upward naturally via the second air convection channel to do heat dissipation.

The lower end of the ring-shaped cavity 5 is connected to the inner cavity of the base 1 via the through holes 13 on the upper surface of the base 1; the inner cavity of the base 1 is connected to the hollow space 6 in the steel frame 4 via the main vents 14 on the upper surface of the base 1; the total area of all the through holes 13 on the upper surface of the base 1 accounts for 20 to 35 percent of the total area of all the main vents 14, so, the heat emitted by the power part in the inner cavity of the base 1 is mainly emitted from the first air convection channel.

The first air convection channel can be internally provided with a pillar flow fan, and the pillar flow fan (not shown in FIG. 4) can be mounted at the main vents 14 on the upper surface of the base 1; the pillar flow fan is made to start periodically, so, the air velocity is increased to improve heat dissipation.

The pillar lamp is internally provided with multiple air convection channels from down to up, thereby being convenient for the natural or forced air convection heat dissipation of the power part, the luminous body, etc. in a large pillar lamp, achieving the energy saving object, and ensuring a long-term safe use of the pillar lamp.

Figure 5:
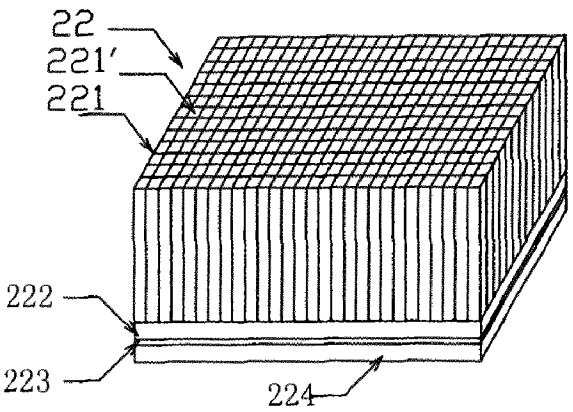
FIG. 5 is a structure schematic diagram of a hot-melt glass lamp plate adopted by the embodiment of FIG. 1.

FIG. 5 is a structure schematic diagram of the hot-melt glass lamp plate of the above mentioned pillar-shaped hot-melt glass lamp. The hot-melt glass lamp plate 22 comprises a layer of crystal pellet glass-head body 221 of a certain thickness, and two layers of crystal glass plates 222, 224; an ultraviolet-curing transparent glue-layer 223 is glued between the two crystal glass plates, and the crystal pellet glass-head body 221 is combined with the contact parts on the adjacent surface of the upper layer of crystal glass plate 222 by hot-melt method; wherein, the crystal pellet glass-head body 221 comprises several crystal pellets 221' being combined by hot-melt method, and these crystal pellets 221' are vertically arranged on the upper layer of crystal glass plate 222, with the contact parts of adjacent crystal pellets 221' being combined by hot-melt method. The thickness of the crystal pellet glass-head body 221 may be between 12 mm and 20 mm.

The above mentioned hot-melt glass lamp plate can also be replaced by other products with the thickness being between 12 mm and 20 mm. For example, a hot-melt glass lamp plate with crystal knitting structure comprises three layers of crystal knitting-strip hot-melt glass of a certain thickness and two layers of crystal glass plates, and its structure is divided into six layers from outside to inside; the outer layer is a first layer of crystal knitting-strip hot-melt glass, and inside the outer layer successively are a second layer of crystal knitting-strip hot-melt glass, a third layer of crystal knitting-strip hot-melt glass, a first layer of crystal glass plate, a transparent glue-layer, and a second layer of crystal glass plate; the transparent glue-layer is glued between the first layer and the second layer of crystal glass plates; the contact parts on the adjacent surfaces between the three layers of crystal knitting-strip hot-melt glass are combined moderately by hot-melt method; the contact parts on the adjacent surfaces between the third crystal knitting-strip hot-melt glass and the first crystal plate are combined moderately by hot-melt method.

A multi-channel heat dissipation method for the above mentioned hot-melt glass pillar lamp comprises:

Step 1. mounting a hollow steel frame 4 on a base 1, several sections of pillar-shaped hot-melt glass lamp 2 surrounding the steel frame 4 and being sequentially arranged on the base 1 from down to up in an overlapping manner, a ring-shaped cavity 5 being formed between the inner walls of the lamp plates 22 of all the pillar-shaped hot-melt glass lamps 2 and the outer walls of the steel frame 4, all the luminous bodies being located in the ring-shaped cavity 5; the upper end of the ring-shaped cavity 5 being open, and the lower end being connected to the inner cavity of the base 1 via several through holes 13 on the upper surface of the base 1; the air inlets 111 of the base 1 or the electric door, the inner cavity of the base 1, the through holes 13 being connected to the inner cavity of the base 1, and the ring-shaped cavity 5 forming a second air convection channel, so, the air absorbing the heat emitted by the luminous bodies, which is hotter than room temperature, flowing upward naturally via the second air convection channel to do heat dissipation; and Step 2. the inner cavity of the base 1 being connected to the hollow space 6 in the steel frame 4 via the main vents 14 on the upper surface of the base 1; the air inlets 111 of the base 1 or the electric door, the inner cavity of the base 1, the main vents 14, the hollow space 6 in the steel frame 4, and the air outlets 33 of the lamp cover 3 at the upper opening part of the steel frame 4 forming a first air convection channel, so, the air in the inner cavity of the base 1, which absorbs the heat emitted by the power part and is hotter than room temperature, flowing upward naturally via the first air convection channel to do heat dissipation.

The total area of all the through holes 13 on the base 1 accounts for 20 to 35 percent of the total area of all the main vents 14 on the base 1, so, the heat emitted by the power part in the inner cavity of the base 1 is mainly emitted from the first air convection channel.

The first air convection channel can be internally provided with a pillar flow fan, so as to increase the air velocity to improve heat dissipation.

What is claimed is:

1. A hot-melt glass pillar lamp comprising:

a base, the base being internally provided with a power part;

a steel frame, the steel frame being hollow and mounted on the middle of the base;

a plurality of sections of pillar-shaped hot-melt glass lamp surrounding the steel frame and being sequentially arranged on the base from down to up in an overlapping manner; wherein, each section of the pillar-shaped hot-melt glass lamp including a fixing framework which is composed of a plurality of supporting bars and a supporting board, each surface of the fixing framework being separately provided with a hot-melt glass lamp plate; an LED lamp plate being arranged at a certain distance from the inner side of each hot-melt glass lamp plate, and on the corresponding surface of the steel frame; and a lamp cover, the lamp cover being provided with air outlets and mounted to the upper end of the hollow steel frame.

2. The hot-melt glass pillar lamp of claim 1, wherein the hot-melt glass lamp plate comprises a layer of crystal pellet glass-head body, and two layers of crystal glass plates; an ultraviolet-curing transparent glue-layer is glued between the two layers of crystal glass plate, and the crystal pellet glass-head body is combined with the contact parts on the adjacent surface of the upper layer of crystal glass plate by hot-melt method; the crystal pellet glass-head body comprises a plurality of crystal pellets being combined by hot-melt method, and these crystal pellets are vertically arranged on the upper layer of crystal glass plate, with the contact parts of adjacent crystal pellets being combined by hot-melt method.

3. The hot-melt glass pillar lamp of claim 1, wherein the LED lamp plate of the pillar-shaped hot-melt glass lamp is provided with a plurality of LEDs emitting white light, which are mounted at intervals.

4. The hot-melt glass pillar lamp of claim 3, wherein the hot-melt glass lamp plate comprises a layer of crystal pellet glass-head body, and two layers of crystal glass plates; an ultraviolet-curing transparent glue-layer is glued between the two layers of crystal glass plate, and the crystal pellet glass-head body is combined with the contact parts on the adjacent surface of the upper layer of crystal glass plate by hot-melt method.

5. The hot-melt glass pillar lamp of claim 3, wherein the longitudinal edges of each LED lamp plate are also provided with one to three columns of LEDs emitting white light; these LEDs emitting white light are higher than the other LEDs, and they incline towards the longitudinal edge of the adjacent hot-melt glass lamp plate, so as to increase the luminance of the corners of the pillar-shaped hot-melt glass lamp.

6. The hot-melt glass pillar lamp of claim 1, wherein the lamp cover comprises a cover plate; a ring-shaped connecting part matching the upper opening part of the steel frame extends from the lower surface of the cover plate; each surface of the ring-shaped connecting part is provided with air outlets.

7. The hot-melt glass pillar lamp of claim 6, wherein the hot-melt glass lamp plate comprises a layer of crystal pellet glass-head body, and two layers of crystal glass plates; an ultraviolet-curing transparent glue-layer is glued between the two layers of crystal glass plate, and the crystal pellet glass-head body is combined with the contact parts on the adjacent surface of the upper layer of crystal glass plate by hot-melt method; the crystal pellet glass-head body comprises a plurality of crystal pellets being combined by hot-melt method, and these crystal pellets are vertically arranged on the upper layer of crystal glass plate, with the contact parts of adjacent crystal pellets being combined by hot-melt method.

8. The hot-melt glass pillar lamp of claim 1, wherein the inner cavity of the base is connected to the hollow space in the steel frame via main vents on the base; the electric door of the base or the base is provided with a plurality of air inlets; these air inlets, the inner cavity of the base, the main vents, the hollow space in the steel frame, and the air outlets of the lamp cover at the upper opening part of the steel frame form a first air convection channel, so, the air in the inner cavity of the base, which absorbs the heat emitted by the power part and is hotter than room temperature, flows upward naturally via the first air convection channel to do heat dissipation.

9. The hot-melt glass pillar lamp of claim 8, wherein a ring-shaped cavity is formed between the inner walls of the hot-melt glass lamp plates of the pillar-shaped hot-melt glass lamps and the outer walls of the steel frame, and the lower end of the ring-shaped cavity is provided with a plurality of through holes being connected to the inner cavity of the base; the air inlets of the electric door or the base, the inner cavity of the base, the through holes being connected to the inner cavity of the base, and the ring-shaped cavity form a second air convection channel, so, the air absorbing the heat emitted by the LED lamps, which is hotter than room temperature, flows upward naturally via the second air convection channel to do heat dissipation.

10. The hot-melt glass pillar lamp of claim 9, wherein the lower end of the ring-shaped cavity is connected to the inner cavity of the base via the through holes on the upper surface of the base; the inner cavity of the base is connected to the hollow space in the steel frame via the main vents on the upper surface of the base; the total area of all the through holes accounts for 20 to 35 percent of the total area of all the main vents.

11. The hot-melt glass pillar lamp of claim 9, wherein the hot-melt glass lamp plate comprises a layer of crystal pellet glass-head body, and two layers of crystal glass plates; an ultraviolet-curing transparent glue-layer is glued between the two layers of crystal glass plate, and the crystal pellet glass-head body is combined with the contact parts on the adjacent surface of the upper layer of crystal glass plate by hot-melt method.

12. The hot-melt glass pillar lamp of claim 11, wherein the crystal pellet glass-head body comprises a plurality of crystal pellets being combined by hot-melt method, and these crystal pellets are vertically arranged on the upper layer of crystal glass plate, with the contact parts of adjacent crystal pellets being combined by hot-melt method.

13. The hot-melt glass pillar lamp of claim 8, wherein the first air convection channel is internally provided with a pillar flow fan.

14. A multi-channel heat dissipation method for a hot-melt glass pillar lamp comprising:

Step 1. mounting a hollow steel frame on a base, a plurality of sections of pillar-shaped hot-melt glass lamp surrounding the steel frame and being sequentially arranged on the base from down to up in an overlapping manner, a ring-shaped cavity being formed between the inner walls of the lamp plates of all the pillar-shaped hot-melt glass lamps and the outer walls of the steel frame, all the luminous bodies being located in the ring-shaped cavity; the lower end of the ring-shaped cavity being connected to the inner cavity of the base via a plurality of through holes on the base; the air inlets of the base or the electric door, the inner cavity of the base, the through holes being connected to the inner cavity of the base, and the ring-shaped cavity forming a second air convection channel, so, the air absorbing the heat emitted by the luminous bodies, which is hotter than room temperature, flowing upward naturally via the second air convection channel to do heat dissipation; and Step 2. the inner cavity of the base being connected to the hollow space in the steel frame via the main vents on the base; the air inlets of the base or the electric door, the inner cavity of the base, the main vents, the hollow space in the steel frame, and the air outlets of the lamp cover at the upper opening part of the steel frame forming a first air convection channel, so, the air in the inner cavity of the base, which absorbs the heat emitted by the power part and is hotter than room temperature, flowing upward naturally via the first air convection channel to do heat dissipation.

15. The multi-channel heat dissipation method of claim 14, wherein the first air convection channel is internally provided with a pillar flow fan.

16. The multi-channel heat dissipation method of claim 14, wherein the total area of all the through holes on the upper surface of the base accounts for 20 to 35 percent of the total area of all the main vents on the upper surface of the base.

* * * * *